US011763768B2

(12) United States Patent
Li

(10) Patent No.: US 11,763,768 B2
(45) Date of Patent: Sep. 19, 2023

(54) METHOD FOR CHARGING LIQUID CRYSTAL PIXELS, DISPLAY PANEL, AND STORAGE MEDIUM

(71) Applicant: HKC CORPORATION LIMITED, Shenzhen (CN)

(72) Inventor: Wenxin Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 282 days.

(21) Appl. No.: 17/042,707

(22) PCT Filed: Dec. 18, 2018

(86) PCT No.: PCT/CN2018/121839
§ 371 (c)(1),
(2) Date: Mar. 22, 2021

(87) PCT Pub. No.: WO2020/107558
PCT Pub. Date: Jun. 4, 2020

(65) Prior Publication Data

US 2021/0210041 A1 Jul. 8, 2021

(30) Foreign Application Priority Data

Nov. 26, 2018 (CN) ..... 201811423722.2

(51) Int. Cl.
*G09G 3/36* (2006.01)

(52) U.S. Cl.
CPC ... *G09G 3/3677* (2013.01); *G09G 2310/0213* (2013.01); *G09G 2310/06* (2013.01); *G09G 2320/0233* (2013.01)

(58) Field of Classification Search
CPC ..... G09G 3/3677; G09G 2310/0213; G09G 2310/06; G09G 2320/0233; G09G 2310/0251; G09G 2310/04; G09G 3/36
See application file for complete search history.

(56) References Cited

U.S. PATENT DOCUMENTS

2006/0028418 A1 2/2006 Mu-Shan et al.
2017/0004785 A1* 1/2017 Qi ..... G09G 3/2092

FOREIGN PATENT DOCUMENTS

CN 1360299 A 7/2002
CN 101414089 A 4/2009
(Continued)

OTHER PUBLICATIONS

First Office Action in counterpart Chinese Application No. 201811423722.2, dated Dec. 3, 2019.
(Continued)

*Primary Examiner* — Jonathan A Boyd
(74) *Attorney, Agent, or Firm* — Westbridge IP LLC

(57) ABSTRACT

Disclosed is a method for charging liquid crystal pixels, which includes: pre-charging in sequence a preset number of pixel rows of a current frame from an initial pixel row; charging in sequence the pixel rows from the initial pixel row when the current frame is started to be charged; and acquiring a target pixel row corresponding to currently charged pixel row, when each of the pixel rows is charged, pre-charging the target pixel row, and the target pixel row is charged later than the currently charged pixel row. The present disclosure also provides a display panel and a computer readable storage medium.

15 Claims, 4 Drawing Sheets

(56) References Cited

FOREIGN PATENT DOCUMENTS

| | | | |
|---|---|---|---|
| CN | 101995708 | A | 3/2011 |
| CN | 103236244 | A | 8/2013 |
| CN | 106128377 | A | 11/2016 |
| CN | 106683630 | A | 5/2017 |
| CN | 106782381 | A | 5/2017 |
| CN | 108877725 | A | 11/2018 |

OTHER PUBLICATIONS

International Search Report and Written Opinion in corresponding PCT Application No. PCT/CN2018/121839, dated Aug. 30, 2019.
Second Office Action in counterpart Chinese Application No. 201811423722.2, dated Apr. 7, 2020.
Third Office Action in counterpart Chinese Application No. 201811423722.2, dated Jul. 16, 2020.

* cited by examiner

METHOD FOR CHARGING LIQUID CRYSTAL PIXELS, DISPLAY PANEL, AND STORAGE MEDIUM

CROSS-REFERENCE TO RELATED APPLICATIONS

The present disclosure is the National Stage of International Application No. PCT/CN2018/121839, filed on Dec. 18, 2018, which claims the priority of Chinese Patent Application No. 201811423722.2, entitled "METHOD FOR CHARGING LIQUID CRYSTAL PIXELS, DISPLAY PANEL AND STORAGE MEDIUM", filed on Nov. 26, 2018, which is hereby incorporated by reference in its entirety.

TECHNICAL FIELD

The present disclosure relates to the technical field of display, in particular to a method for charging liquid crystal pixels, a display panel, and a computer readable storage medium.

BACKGROUND

At present, the liquid crystal display panel can be charged and driven through sequentially turning on the pixel rows. In detail, a scan voltage is provided to each of gate rows of the display panel. Each of rising edges of the clock could generate a digital signal which corresponds to an output. The outputs are then subjected to digital-to-analogue conversion, the high and low electric level can be converted to the high and the low voltage, to turn on the gate rows of the display panel row by row, and charge the pixel electrode.

As the display panel needs to be driven by an alternating current, in order to complete the charging of the pixels faster, the pre-charge technology can be adopted to turn on the row scan signal in advance. When one of the pixel rows is charged, a next pixel row can be pre-charged simultaneously, so that the pixels can be charged to the required potential faster during their actual charging time.

Since the gate rows of the display panel needs to be turned on in sequence from the initial gate row, the latter pixel rows are not only pre-charged but also charged conventionally, while the front pixel rows can only be charged conventionally without being pre-charged, making the front pixel rows darker than the other pixel rows, further leading to an undesirable display.

SUMMARY

It is therefore one main objective of the disclosure to provide a method for charging liquid crystal pixels, a display panel, and a computer readable storage medium, aiming to improve effect of charging the display panel.

In order to achieve the above objective, the present disclosure provides a method for charging liquid crystal pixels, which includes the following operations:

pre-charging in sequence a preset number of pixel rows of a current frame from an initial pixel row;

charging in sequence the pixel rows from the initial pixel row when the current frame is started to be charged; and acquiring a target pixel row corresponding to a currently charged pixel row, when each of the pixel rows is charged, pre-charging the target pixel row, and the target pixel row is charged later than the currently charged pixel row.

Optionally, the operation of pre-charging in sequence the preset number of pixel rows of the current frame from the initial pixel row, includes:

providing in sequence a scan voltage to gates corresponding to the preset number of the pixel rows of the current frame from the initial pixel row, for pre-charging the preset number of the pixel rows.

Optionally, the operation of providing in sequence the scan voltage to gates corresponding to the preset number of the pixel rows of the current frame from the initial pixel row, includes:

generating a frame start signal when a number of remaining timing rows of the row clock signal of a previous frame is equal to a number of gate rows corresponding to the preset number of the pixel rows; and sequentially turning on the gates corresponding to the preset number of the pixel rows according to the frame start signal, to provide the scan voltage to the gates.

Optionally, the operation of acquiring the target pixel row corresponding to the currently charged pixel row, when each of the pixel rows is charged, includes:

acquiring the target pixel row corresponding to the currently charged pixel row according to a preset formula and the preset number, when each of the pixel rows is charged.

Optionally, when the preset number is two, the operation of pre-charging in sequence a preset number of pixel rows of the current frame from the initial pixel row, includes:

pre-charging first two pixel rows of the current frame in sequence from the initial pixel row;

the operation of pre-charging the first two pixel rows of the current frame in sequence from the initial pixel row, includes:

acquiring and taking a next-two pixel row relative to the currently charged pixel row as the target pixel row when each of the pixel rows is charged.

Optionally, the operation of pre-charging the first two pixel rows of the current frame in sequence from the initial pixel row, includes:

providing a scan voltage in sequence to first four gate rows of the current frame from an initial gate row for pre-charging the first two pixel rows, when the liquid crystal pixels are driven by two gates and a number of remaining timing rows of a row clock signal of a previous frame is four.

Optionally, the operation of pre-charging the first two pixel rows of the current frame in sequence from the initial pixel row, includes:

providing a scan voltage in sequence to first two gate rows of the current frame from an initial gate row, for pre-charging the first two pixel rows, when the liquid crystal pixels are driven by a single gate and a number of remaining timing rows of a row clock signal of a previous frame is two.

Optionally, the operation of charging in sequence the pixel rows from the initial pixel row when the current frame is started to be charged, includes:

sequentially turning on a gate corresponding to each of the pixel rows according to a row clock signal of the current frame from the initial pixel row, when the current frame is started to be charged; and turning on a pixel switch corresponding to the gate for charging each pixel row corresponding to the gate, when the gate corresponding to each of the pixel rows is turned on.

In order to achieve the above objective, the present disclosure further provides a display panel, which includes:

a memory, a processor, and a program for charging liquid crystal pixels stored on the memory and executable on the processor. The program for charging liquid crystal pixels when executed by the processor performs the operations of the method for charging liquid crystal pixels as described above.

In order to achieve the above objective, the present disclosure further provides a computer readable storage medium. The computer readable storage medium stores a program for charging liquid crystal pixels, the program for charging liquid crystal pixels when executed by a processor performs the operations of the method for charging liquid crystal pixels as described above.

The present disclosure provides the method for charging liquid crystal pixels, the display panel, and the computer readable storage medium. The preset number of pixel rows are pre-charged in sequence from the initial pixel row of the current frame; all of the pixel rows are charged in sequence from the initial pixel row when the current frame is started to be charged; and a target pixel row corresponding to the currently charged pixel row is acquired and pre-charged, when each of the pixel rows is charged, the target pixel row is charged later than the currently charged pixel row. As such, the pixel rows which cannot been pre-charged due to the precharge protocol of the current frame can be pre-charged in advance before the current frame is charged, so that the pixel rows can be fully charged when the current frame is charged. The display panel can be fully charged due to an sufficiently charging for the pixels, improving the display due to insufficiently charging for the display panel.

The realizing of the aim, functional characteristics, advantages of the present disclosure are further described in detail with reference to the accompanying drawings and the embodiments.

DETAILED DESCRIPTION OF EMBODIMENTS

It is to be understood that the exemplary embodiments of the present disclosure are used for illustrating the present disclosure rather than restricting the present disclosure.

The present disclosure provides a method for charging liquid crystal pixels. The pixel rows which cannot been pre-charged due to the precharge protocol of the current frame can be pre-charged in advance before charging the current frame, so that the pixel rows can be better charged. The problem of that the display panel cannot be fully charged due to an insufficiently charging for parts of the pixels, and further solving the problem of bad display effect due to insufficiently charging for the display panel.

Figure 1:
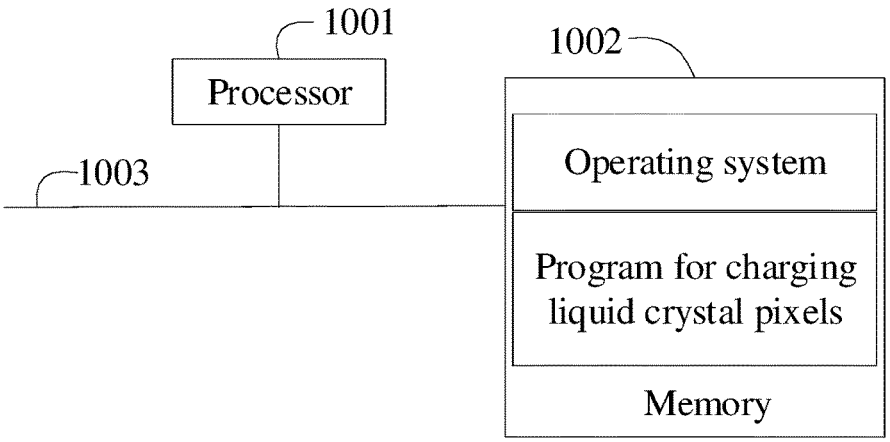
FIG. 1 is a schematic diagram of a hardware operating environment of a terminal according to some embodiments of the present disclosure.

As shown in FIG. 1, FIG. 1 is a schematic diagram of a hardware operating environment of a terminal according to some embodiments of the present disclosure.

The terminal of the exemplary embodiment of the present disclosure can be a liquid crystal display panel or a control device of the display panel.

As shown in FIG. 1, the terminal may include a processor 1001, such as a Central Processing Unit (CPU), a memory 1002, and a communication bus 1003. The communication bus 1003 is configured to realize connection and communication among the above components of the terminal. The memory 1002 may be a high-speed Random Access Memory (RAM) or a non-volatile memory such as a disk memory. The memory 1002 may alternatively be a storage device independent of the aforementioned processor 1001.

Those skilled in the art can understand that the structure of the terminal shown in FIG. 1 does not constitute a limitation on the terminal of the embodiment of the present disclosure, and the terminal may include more or fewer components than shown, or a combination of some of the components, or different components.

As shown in FIG. 1, the memory 1002 as a computer storage medium may include a program for charging liquid crystal pixels.

In the terminal as shown in FIG. 1, the processor 1001 may be configured to call the program for charging liquid crystal pixels stored on the memory 1002 and perform the following operations:

pre-charging in sequence a preset number of pixel rows of a current frame from an initial pixel row;

charging in sequence the pixel rows from the initial pixel row when the current frame is started to be charged; and acquiring a target pixel row corresponding to currently charged pixel row, when each of the pixel rows is charged, pre-charging the target pixel row, and the target pixel row is charged later than the currently charged pixel row.

Further, the processor 1001 may call the program for charging liquid crystal pixels stored on the memory 1002, and further perform the following operations:

providing in sequence a scan voltage to gates corresponding to the preset number of the pixel rows of the current frame from the initial pixel row, for pre-charging the preset number of the pixel rows.

Further, the processor 1001 may call the program for charging liquid crystal pixels stored on the memory 1002, and further perform the following operations:

generating a frame start signal, when a number of remaining timing rows of the row clock signal of a previous frame is equal to a number of gate rows corresponding to the preset number of the pixel rows; and sequentially turning on the gates corresponding to the preset number of the pixel rows according to the frame start signal, to provide the scan voltage to the gates.

Further, the processor 1001 may call the program for charging liquid crystal pixels stored on the memory 1002, and further perform the following operations:

acquiring the target pixel row corresponding to the currently charged pixel row according to a preset formula and the preset number, when each of the pixel rows is charged.

Further, the processor 1001 may call the program for charging liquid crystal pixels stored on the memory 1002, and further perform the following operations:

pre-charging first two pixel rows of the current frame in sequence from the initial pixel row.

the operation of when charging each of the pixel rows, acquiring the target pixel row corresponding to the currently charged pixel row includes:

acquiring and taking a next-two pixel row relative to the currently charged pixel row as the target pixel row when each of the pixel rows is charged.

Further, the processor 1001 may call the program for charging liquid crystal pixels stored on the memory 1002, and further perform the following operations:

providing a scan voltage in sequence to first four gate rows of the current frame from an initial gate row for pre-charging the first two pixel rows, when the liquid crystal pixels are driven by two gates and a number of remaining timing rows of a row clock signal of a previous frame is four.

Further, the processor 1001 may call the program for charging liquid crystal pixels stored on the memory 1002, and further perform the following operations:

providing a scan voltage in sequence to first two gate rows of the current frame from an initial gate row, for pre-charging the first two pixel rows, when the liquid crystal pixels are driven by a single gate and a number of remaining timing rows of a row clock signal of a previous frame is two.

Further, the processor 1001 may call the program for charging liquid crystal pixels stored on the memory 1002, and further perform the following operations:

sequentially turning on a gate corresponding to each of the pixel rows from the initial pixel row according to a row clock signal of the current frame, when the current frame is started to be charged; and turning on a pixel switch corresponding to the gate for charging each pixel row corresponding to the gate, when the gate corresponding to each of the pixel rows is turned on.

Figure 2:
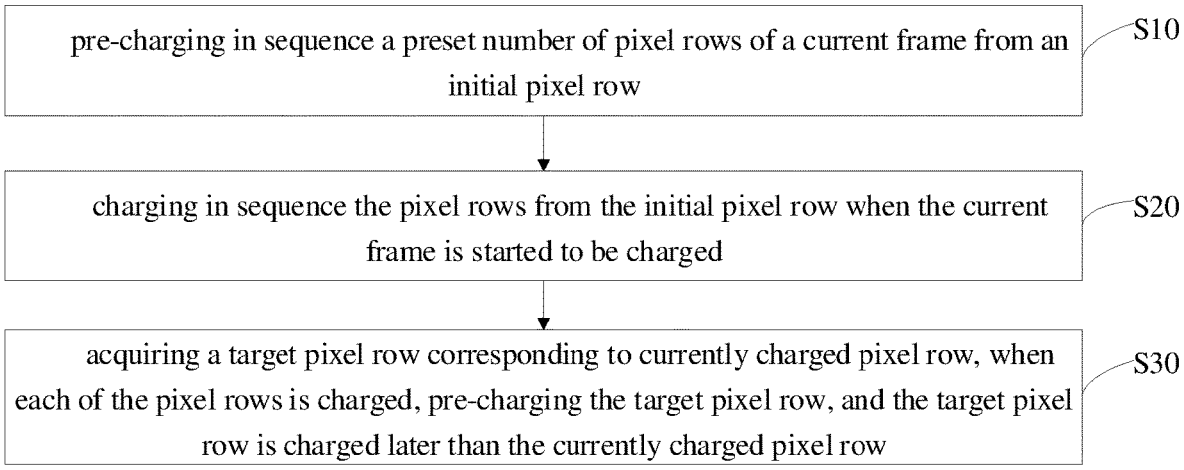
FIG. 2 is a flow chart of a method for charging liquid crystal pixels according to some embodiments of the present disclosure.

Referring to FIG. 2, in one embodiment, the method for charging liquid crystal pixels includes:

S10: pre-charging in sequence a preset number of pixel rows of a current frame from an initial pixel row.

In the exemplary embodiment, currently, Thin Film Transistor Liquid Crystal Display (TFT-LCD) is one of the main types of the flat panel display, and has become an important display platform of modern Information Technology (IT) products and video products. The main driving principle of TFT-LCD is that the main system board can connect a R/G/B compressed signal, a control signal, and a power with connectors on the Printed Circuit Board (PCB) through wires. Data, after being processed by Timing Controller Integrated Circuit (TCON-IC) on PCB, can be transmitted to a display area through the PCB, Source-Chip on Film (S-COF), and Gate-Chip on Film (G-COF).so as to obtain the required power and signals for LCD.

The pixels of a display panel are turned on and charged row by row. Specifically, each of gate rows of the display panel, that is, the gate row corresponding to each of pixel rows, receives a row scan signal, and a digital signal is generated every one rising edge of one clock is passed, and each of the digital signals corresponds to an output which is subjected to a digital-to-analogue conversion. As such the high level and low level can be converted into the high voltage and low voltage, so that the display panel is turned on row by row and then charged through pixel electrodes.

Since the liquid crystal display panel needs to be driven by an alternating current, in order to charge the pixels quickly, the precharge technology can be used to generate the row scan signal in advance. As such the pixel row is normally charged while a next pixel row can be pre-charged, so that the pixels can reach the required potential faster during their actual charging time.

Figure 6:
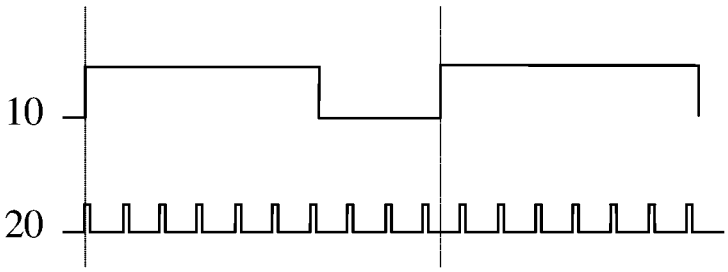
FIG. 6 is a schematic diagram of a control of the picture displayed in each frame of the display panel correspondingly by the frame clock signal and the row clock signal flow chart of a method for charging liquid crystal pixels according to some further embodiments of the present disclosure.

Referring to FIG. 6, the picture displayed in each frame of the display panel can be controlled correspondingly by the frame clock signal 10 and the row clock signal 20. In which one cycle of the frame clock signal 10 corresponds to a displaying cycle of one frame. In one cycle of the frame clock signal 10, the high level can enable the corresponding function. The row clock signal 20 can be controlled by the frame clock signal 10. When the frame clock signal 10 is the high level, each pulse of the row clock signal 20 can turn on one gate row and output a row scan signal correspondingly, to provide the scan voltage to the gate row.

Taking a high definition (HD) display panel as an example, the HD display panel has 1366*768 pixels, having 768 pixel rows. When HD display panel adopts a single-gate driving design, HD display panel has 768 gate rows, that is, when the frame clock signal of each frame outputs the high level, the row clock signal has 768 rising pulses. While, according to a protocol of the single-gate driving design of the HD display panel, the row clock signal has 806 rising pulses during the display period of one frame. So 38 rising pulses of the row clock signal correspond to the low-level output of the frame clock signal. Therefore, it is not necessary to supply the scan voltage to the gate row of the current frame at the $769^{th}$ rising edge of the row clock signal of each frame.

When the HD display panel adopts the dual-gate driving design, the HD display panel has 1536 gate rows. That is, when the frame clock signal of each frame outputs the high level, the row clock signal has 1536 rising pulses. While, according to the protocol of the dual-gate driving design of the HD display panel, the row clock signal has 1612 rising pulses during the displaying period of one frame. So 76 rising pulses of the row clock signal correspond to the low-level output of the frame clock signal. Therefore, it is not necessary to supply the scan voltage to the gate row of the current frame at the $1537^{th}$ rising edge of the row clock signal of each frame.

Therefore, in order to solve the problem that some pixel rows can not be pre-charged due to the precharge protocol (under the limit of the precharge protocol, only the next-two pixel row relative to the currently charged pixel row can be pre-charged). When the frame clock signal of the previous frame is low level and the row clock signal still has some rising pluses, that is, the row clock signal is still timing, the pixel rows of the current frame which cannot be pre-charged due to the precharge protocol can be pre-charged before charging the pixel rows of the current frame through adopting the protocol of the display period of each frame.

Specifically, before the current frame is charged, that is, before the frame start signal corresponding to the current frame is arrived, the preset number of pixel rows of the current frame are pre-charged from the initial pixel row of the current frame during the period when the frame clock signal of the previous frame is the low level. For example, when the preset number is two, the first pixel row and the second pixel row of the current frame are pre-charged.

Specifically, during the period when the frame clock signal of the previous frame is the low level, the scan voltage is provided to gate rows corresponding to the preset number of pixel rows from the gate row corresponding to the initial pixel row of the current frame, for pre-charging the preset number of pixel rows.

S20: charging in sequence the pixel rows from the initial pixel row when the current frame is started to be charged.

Specifically, when charging the current frame, that is, before the arrival of the frame start signal of the current frame, the gate rows corresponding to the pixel rows are sequentially turned on row by row from the initial pixel row of the current frame according to the row clock signal of the current frame. And when the gate row corresponding to each of pixel row is turned on, the pixel switch corresponding to the gate row is also turned on to charge the pixel row corresponding to the gate row. As such, the frame clock signal of the current frame is regarded output as the high electric level.

It should be noted that the frame start signal is a configured to control to charge each frame. The gate rows can be turned on row by row through the initial gate row according to the frequency of the row clock signal when the rising edge of the frame start signal is started.

S30: acquiring a target pixel row corresponding to a currently charged pixel row when charging each of the pixel rows, pre-charging the target pixel row, the target pixel row is charged later than the currently charged pixel row.

The target pixel row is charged later than that of the currently charged pixel row, that is, the target pixel row is arranged after the current pixel row. The currently charged pixel row may have a preset corresponding relationship with the target pixel row. Specifically, the target pixel row corresponding to the currently charged pixel row can be obtained according to a preset formula and the preset number. The preset formula is as follows:

$$S=N+M$$

In which, N is the row number of currently charged pixel rows, M is the preset number, that is, the target pixel row is arranged at the next $M^{th}$ row relative tothe currently charged pixel row, and when the currently charged pixel row is the $N^{th}$ row, the target pixel row is the St row.

As such, since the front M pixel rows of the current frame have been pre-charged before charging the current frame, all pixel rows of the current frame can be charged uniformly through taking the $M^{th}$ row after the currently charged pixel row as the target pixel row when charging each of pixel rows of the current frame. That is, the target pixel row corresponding to the currently charged pixel row is obtained according to the preset formula and the preset number, and then the target pixel row is pre-charged, ensuring all pixel rows of the current frame can be uniformly charged.

In some exemplary embodiments, the preset number of pixel rows are pre-charged in sequence from the initial pixel row of the current frame. All of the pixel rows are charged in sequence from the initial pixel row when the current frame is started to be charged. A target pixel row corresponding to the currently charged pixel row is acquired when charging each of the pixel rows, the target pixel row is pre-charged, the target pixel row is charged later than the currently charged pixel row. In this way, the pixel rows which cannot been pre-charged due to the precharge protocol of the current frame can be pre-charged in advance before charging the current frame, so that the pixel rows can be fully charged when the current frame is charged. The problem that the display panel cannot be fully charged due to an insufficiently charging for parts of the pixels can be overcome, improving the display performance by sufficiently charging.

Figure 3:
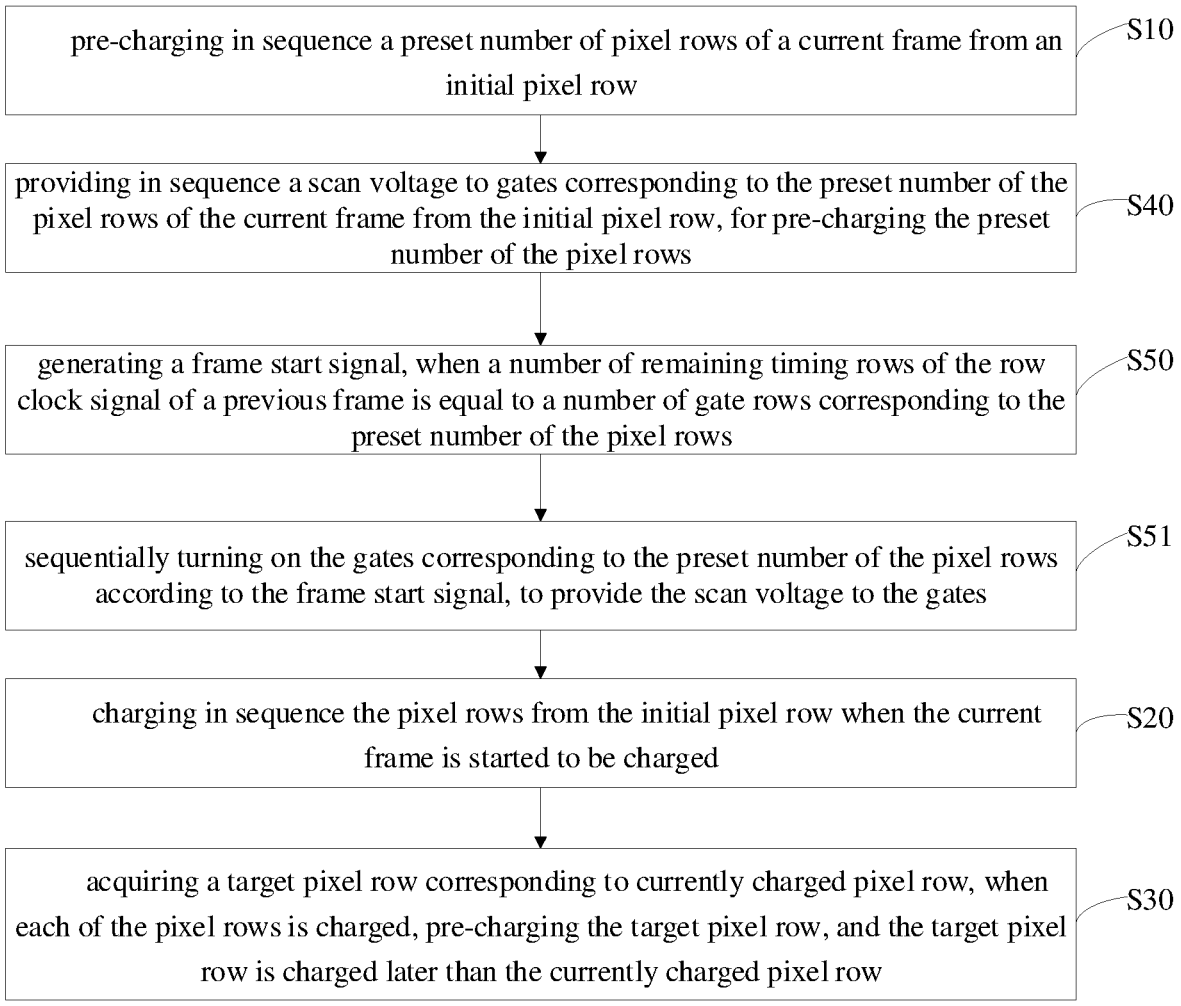
FIG. 3 is a flow chart of a method for charging liquid crystal pixels according to some other embodiments of the present disclosure.

In some other exemplary embodiments, as shown in FIG. 3, on the basis of the above exemplary embodiment as shown in FIG. 2, the operation of pre-charging in sequence the preset number of pixel rows of the current frame from the initial pixel row includes:

S40: providing in sequence a scan voltage to gates corresponding to the preset number of the pixel rows of the current frame from the initial pixel row, for pre-charging the preset number of the pixel rows;

S50: generating a frame start signal, when a number of remaining timing rows of the row clock signal of a previous frame is equal to a number of gate rows corresponding to the preset number of the pixel rows;

S51, sequentially turning on the gates corresponding to the preset number of the pixel rows according to the frame start signal, to provide the scan voltage to the gates.

In the exemplary embodiments, before charging the current frame, that is, before the arrival of the frame start signal corresponding to the current frame, the preset number of pixel rows of the current frame is pre-charged from the initial pixel row of the current frame during the period of that the frame clock signal of the previous frame is low level. For example, when the preset number is two, the first pixel row and the second pixel row of the current frame are pre-charged.

Specifically, when the frame clock signal of the previous frame is the low level, the row clock signal corresponding to the above frame clock signal of the previous frame is acquired. Taking an dual-gate driven HD display pane as an example, the line clock signal starting from the $1537^{th}$ rising edge corresponds to the frame clock signal of the previous frame which is low level.

According to the preset number of pixel rows of the current frame, when the number of remaining timing rows of the row clock signal of the previous frame is equal to the number of gate rows corresponding to the preset number of pixel rows, a frame start signal is generated. Taking a dual-gate driven HD display panel as an example, when the preset number is two, the two pixel rows correspond to four gate rows, and the row clock signal of each frame of the display panel has 1612 row clock signals, that is, a new frame start signal is generated when the $1609^{th}$ rising edge of the row clock signal of the previous frame is arrived, to turn on the gate lines corresponding to the preset number of pixel rows.

Specifically, the rising edge of the newly generated frame start signal coincides with the $1609^{th}$ rising edge of the row clock signal of the previous frame, that is, starting from the $1609^{th}$ rising edge of the row clock signal of the previous frame, each rising edge outputs one row scan signal correspondingly, for supplying scan voltages to the first four row gate rows of the current frame row by row. As such the preset number of pixel rows can be pre-charged.

As such, it is unlikely to precharge pixel rows of the current frame with preset row number in advance before the current frame is charged.

The rising edge of each frame start signal is equivalent to the start signal for charging each of the frames. That is, when the rising edge of each frame start signal arrives, the display frame of the display panel would be recharged from the initial gate row. When the number of remaining timing rows of the row clock signal of the previous frame is equal to the number of gate rows corresponding to the preset number of pixel rows, the frame start signal is generated correspondingly, and the pixel rows of the current frame which need to be pre-charged can be pre-charged accurately.

For example, when the $1609^{th}$ rising edge of the row clock signal of the previous frame is arrived, a new frame start signal is generated, so that the first four gate rows corresponding to the first two pixel rows of the current frame can be pre-charged before the frame start signal of the current frame is received. When the pre-charging of the fourth gate row of the current frame is completed, and the frame start signal of the current frame just arrives, and the pixel rows corresponding to the gate rows can be sequentially charged from the initial gate row of the current frame.

Figure 4:
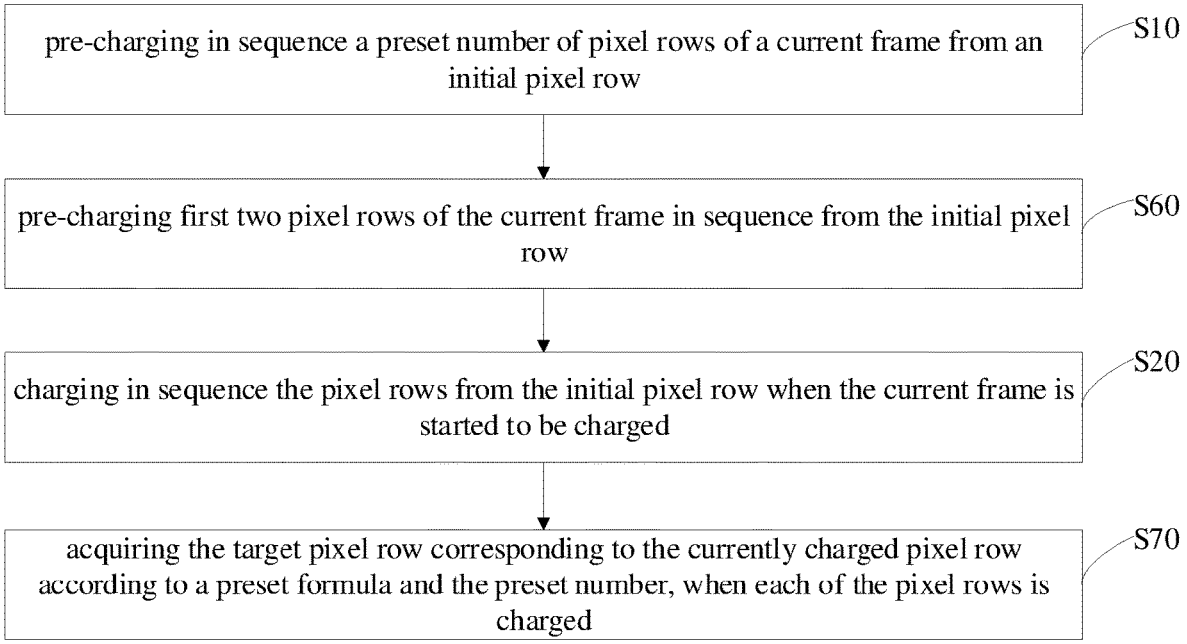
FIG. 4 is a flow chart of a method for charging liquid crystal pixels according to some further embodiments of the present disclosure.

In another exemplary embodiment, as shown in FIG. 4, the preset number is two, on the basis of the above embodiments as shown in FIGS. 2 to 3, and the operation of pre-charging in sequence the preset number of pixel rows of the current frame from the initial pixel row, includes:

S60: pre-charging first two pixel rows of the current frame in sequence from the initial pixel row.

The operation of acquiring the target pixel row corresponding to the currently charged pixel row when each of the pixel rows is charged, includes:

S70: acquiring the target pixel row corresponding to the currently charged pixel row according to a preset formula and the preset number, when each of the pixel rows is charged.

In the exemplary embodiments, since the frames of the liquid crystal display panel are displayed under a drive of inverting polarities of each frame and a corresponding subsequent frame, when one pixel row is charged, the next-two pixel row relative to the currently charged pixel row is obtained as the target pixel row. And the target pixel row is pre-charged, improving the influence of voltage caused by polarity inversion, and enabling the current frame to obtain a good charging effect. However, since the next-two pixel row relative to the currently charged pixel row needs to be pre-charged, the following pixel rows can be charged and pre-charged except for the first two rows of pixel rows of the current frame. The first-two pixel row of the current frame can be pre-charged before the current frame is charged, so that the current frame can be charged fully and uniformly.

Take the dual-gate driven HD display panel as an example, each of the pixel rows of the dual-gate driven HD display panel corresponds to two gate rows. Since the row clock signal of each frame of the dual-gate driven HD display panel has 1612 row clock signals, when the number of remaining timing rows of the row clock signals of the previous frame is four, that is, when the $1609^{th}$ rising edge of the row clock signal of the previous frame is arrived, a new frame start signal is generated, so that scan voltages can be sequentially supplied to the first four gate rows from the initial gate row of the current frame for pre-charging the first two pixel rows.

Specifically, the rising edge of the newly generated frame start signal coincides with the $1609^{th}$ rising edge of the row clock signal of the previous frame, that is, starting from the $1609^{th}$ rising edge of the row clock signal of the previous frame, each rising edge correspondingly outputs one row scan signal, for supplying the scan voltages to the first four gate rows of the current frame row by row, as such the first two pixel rows of the current frame are pre-charged. It should be noted that since the display panel is driven by the alternating current, the output order of the corresponding four scan voltages can be (+, −, −, +) or (−, +, +, −).

Take the single-gate driven HD display panel as an example, each of pixel rows of the single-gate driven HD display panel corresponds to one gate rows. Since the row clock signal of the single-gate driven HD display panel has 806 rows of clock signal, when the number of remaining timing rows of the row clock signal of the previous frame is two, that is, when the $805^{th}$ rising edge of the row clock signal of the previous frame is arrived, a new frame start signal is generated, and the scan voltage can be sequentially supplied to the first two gate rows from the initial gate row of the current frame to precharge the first two pixel rows. It should be noted that one pixel row of the single-gate driven HD display panel corresponds to one gate row; or one pixel row of the single-gate driven HD display panel corresponds to an odd gate row and an even gate row. And the odd numbered gate row is configured to drive the pixel rows of corresponding odd frame, the even numbered gate row is configured to drive the pixel rows of the corresponding even frame.

Specifically, the rising edge of the newly generated frame start signal coincides with the $805^{th}$ rising edge of the row clock signal of the previous frame, that is, starting from the $805^{th}$ rising edge of the row clock signal of the previous frame, each rising edge correspondingly outputs one row scan signal to supply scan voltage to the first two gate rows of the current frame row by row, for pre-charging the first two pixel rows of the current frame.

In some embodiments, before charging the current frame, the first two pixel rows of the current frame are pre-charged sequentially from the initial pixel row. When charging each of the pixel rows, the next-two pixel row relative to the currently charged pixel rowis taken as the target pixel row, and the target pixel row is pre-charged. In this way, the gate rows corresponding to the first two pixel rows which cannot been pre-charged due to the precharge protocol of the current frame can be provided with a voltage, so that the first two pixel rows can be fully charged when the current frame is charged. The current frame can be uniformly charged, and the display panel can be fully charged.

Figure 5:
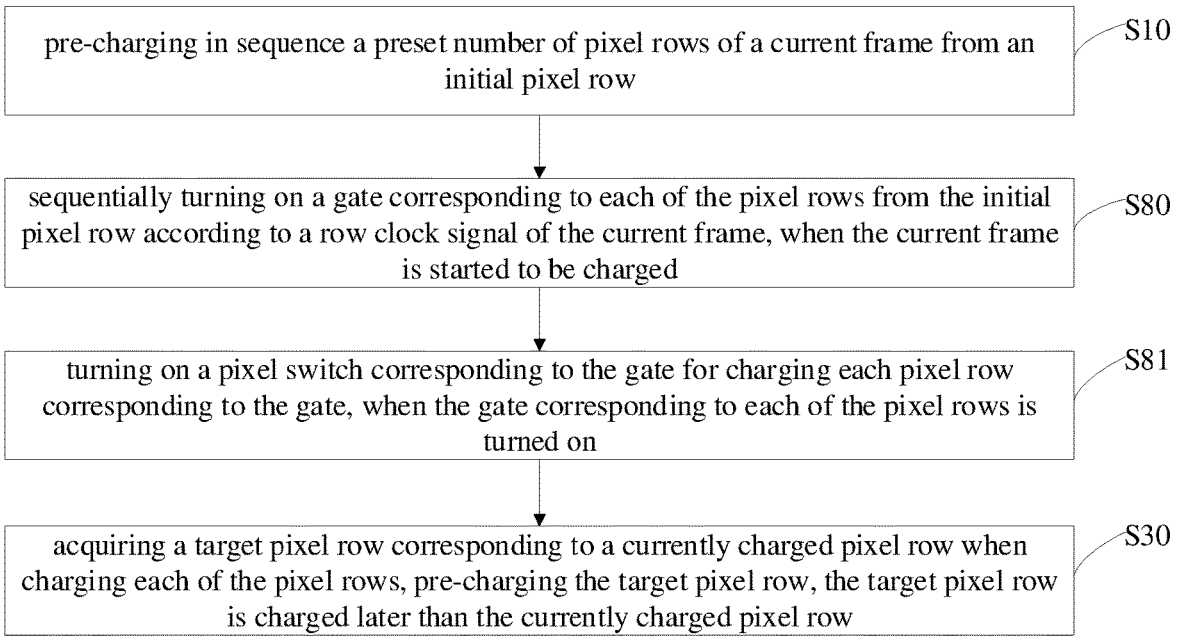
FIG. 5 is a flow chart of a method for charging liquid crystal pixels according to some further embodiments of the present disclosure.

In some further embodiments, as shown in FIG. 5, on the basis of the above embodiments as shown in FIGS. 2 to 4, the operation of charging in sequence the pixel rows from the initial pixel row when the current frame is started to be charged, includes:

S80: sequentially turning on a gate corresponding to each of the pixel rows from the initial pixel row according to a row clock signal of the current frame, when the current frame is started to be charged; and

S81: turning on a pixel switch corresponding to the gate for charging each pixel row corresponding to the gate, when the gate corresponding to each of the pixel rows is turned on.

In the embodiments, when charging the current frame, that is, before the frame start signal of the current frame is arrived, the gate rows corresponding to the pixel rows are sequentially turned on row by row from the initial pixel row of the current frame according to the row clock signal of the current frame. When the gate row corresponding to each of pixel row is turned on, the pixel switch corresponding to the gate row is also turned on to charge the pixel row corresponding to the gate row. As such, the frame clock signal of the current frame is at the high electric level.

It should be noted that the frame start signal is configured to control the charging of each frame. The gate rows can be turned on row by row through the initial gate row according to the frequency of the row clock signal from the rising edge of the frame start signal.

Take the dual-gate driven HD display panel as an example, each of the pixel rows of the dual-gate driven HD display panel corresponds to two gate rows. Starting from the rising edge of the first pulse of the line clock signal of the current frame, until the $1536^{th}$ pulses of the line clock signal, the gate rows are sequentially turned on row by row from the first gate row, that is, 1536 gate rows are turned on, for sequentially charging the pixel rows of the current frame, as such the current frame can be fully charged.

In some embodiments, the gate row corresponding to each of the pixel rows is sequentially turned on according to the row clock signal of the current frame from the initial pixel row when the current frame is started to be charged; and when the gate row corresponding to each of the pixel rows is turned on, the pixel switch is turned on corresponding to the gate row, for charging the pixel row corresponding to the gate row. In this way, the pixel rows of the current frame can be charged in sequence, for completing the charging for the current frame.

In addition, the present disclosure also provides a display panel, which includes a memory, a processor, and a program for charging liquid crystal pixels stored on the memory and executable on the processor. The processor implements the operations of the method for charging the liquid crystal pixels as described in the above embodiments when executing the program for charging the liquid crystal pixels.

In addition, the present disclosure also provides a computer readable storage medium, the computer readable storage medium includes a program for charging liquid crystal pixels. The program for charging liquid crystal pixels when executed by the processor performs the operations of the method for charging liquid crystal pixels as described in the above exemplary embodiments.

The sequence number in the above embodiments of the present disclosure is only for the purpose of explanation and not intended to indicate the merits of the embodiments.

Through above description of the embodiments, it should be understood by a person skilled in the art that the present disclosure may be implemented by means of software in connection with necessary universal hardware platform. Of course, the present disclosure may also be implemented by a hardware. However, in many cases the former is more preferred. Based on this understanding, all or the part contributing to the prior art of the technical solution of the present disclosure may be embodied in the form of software. The computer software may be stored in a storage medium (such as ROM/RAM, diskette, or light disk) and include a plurality of instructions which are used to implement the method as described in the various embodiments of the present disclosure by a terminal device (such as a television, a mobile phone, a computer, a server, an air conditioner, or a network device, etc.).

The foregoing description merely depicts some optional embodiments of the present disclosure and therefore is not intended to limit the scope of the application. An equivalent structural or flow changes made by using the content of the specification and drawings of the present application, or any direct or indirect applications of the disclosure on any other related fields shall all fall in the scope of the present disclosure.

What is claimed is:

1. A method for charging liquid crystal pixels, comprising:

during a period when a frame clock signal of a previous frame is a low level, a row clock signal still has some rising pluses;

generating a frame start signal, when a number of remaining timing rows of the row clock signal of the previous frame is equal to a number of gate rows corresponding to a preset number of pixel rows;

sequentially turning on gates corresponding to the preset number of the pixel rows when a rising edge of the frame start signal is started, to provide a scan voltage to the gates for pre-charging the preset number of the pixel rows of a current frame from an initial pixel row;

charging in sequence the pixel rows from the initial pixel row when the current frame is started to be charged; and acquiring a target pixel row corresponding to a currently charged pixel row, when each of the pixel rows is charged, pre-charging the target pixel row, and the target pixel row is charged later than the currently charged pixel row;

the target pixel row calculated by a preset formula:

$$S=N+M$$

wherein N is a row number of the currently charged pixel row, M is the preset number, S is a number of the target pixel row.

2. The method according to claim 1, wherein the operation of generating a frame start signal, when a number of remaining timing rows of the row clock signal of the previous frame is equal to a number of gate rows corresponding to a preset number of pixel rows, comprises:

generating the frame start signal, when the liquid crystal pixels is driven by two gates and the number of remaining timing rows of the row clock signal of the previous frame is twice the preset number of the pixel rows.

3. The method according to claim 1, wherein the operation of generating a frame start signal, when a number of remaining timing rows of the row clock signal of the previous frame is equal to a number of gate rows corresponding to a preset number of pixel rows, comprises:

generating the frame start signal, when the liquid crystal pixels is driven by a single gate and the number of remaining timing rows of the row clock signal of the previous frame is equal to the preset number of the pixel rows.

4. The method according to claim 1, wherein when the preset number is two, pre-charging first two pixel rows of the current frame in sequence from the initial pixel row.

5. The method according to claim 4, wherein taking a next-two pixel row relative to the currently charged pixel row as the target pixel row when each of the pixel rows is charged.

6. The method according to claim 5, wherein the operation of charging all of the pixel rows in sequence from the initial pixel row, when the current frame is started to be charged, comprises:

sequentially turning on a gate corresponding to each of the pixel rows from the initial pixel row according to a row clock signal of the current frame, when the current frame is started to be charged; and turning on a pixel switch corresponding to the gate for charging each pixel row corresponding to the gate, when the gate corresponding to each of the pixel rows is turned on.

7. The method according to claim 4, wherein the method comprises:

generating the frame start signal, when the liquid crystal pixels are driven by two gates and the number of remaining timing rows of the row clock signal of the previous frame is four; and sequentially providing the scan voltage to first four gate rows of the current frame from the initial gate row, for pre-charging the first two pixel rows, according to the frame start signal.

8. The method according to claim 4, wherein the method comprises:

sequentially providing the scan voltage to first four gate rows of the current frame from the initial gate row for pre-charging the first two pixel rows, when the liquid crystal pixels are driven by two gates and the row clock signal of the previous frame is at an 1609th rising edge.

9. The method according to claim 4, wherein the method comprises:

generating the frame start signal, when the liquid crystal pixels are driven by two gates and the row clock signal of the previous frame is at an 1609th rising edge; and sequentially providing the scan voltage to first four gate rows of the current frame from an initial gate row according to the frame start signal, for pre-charging the first two pixel rows.

10. The method according to claim 4, wherein the method comprises:

providing the scan voltage in sequence to first two gate rows of the current frame from the initial gate row, for pre-charging the first two pixel rows, when the liquid crystal pixels are driven by a single gate and the number of remaining timing rows of the row clock signal of the previous frame is two.

11. The method according to claim 4, wherein the method comprises:

generating the frame start signal, when the liquid crystal pixels are driven by a single gate and the number of remaining timing rows of the row clock signal of the previous frame is two; and sequentially providing the scan voltage to a first two gate rows of the current frame from the initial gate row according to the frame start signal, for pre-charging the first two pixel rows.

12. The method according to claim 4, wherein the method comprises:

sequentially providing the scan voltage to first two gate rows from the initial gate row of the current frame, for pre-charging the first two pixel rows, when the liquid crystal pixels are driven by a single gate and the row clock signal of the previous frame is at an 805th rising edge.

13. The method according to claim 1, wherein the operation of charging in sequence the pixel rows from the initial pixel row when the current frame is started to be charged, comprises:

sequentially turning on a gate corresponding to each of the pixel rows from the initial pixel row according to the row clock signal of the current frame, when the current frame is started to be charged; and turning on a pixel switch corresponding to the gate for charging each pixel row corresponding to the gate, when the gate corresponding to each of the pixel rows is turned on.

14. A display panel, wherein the display panel comprises a memory, a processor, and a program stored on the memory and executable on the processor, and the program, when executed by the processor, performing the method for charging liquid crystal pixels according to claim 1.

15. A non-transitory computer readable storage medium, wherein the non-transitory computer readable storage medium stores a program for charging liquid crystal pixels, the program for charging liquid crystal pixels, when executed by a processor, performing the method for charging liquid crystal pixels according to claim 1.

* * * * *